United States Patent [19]

Schuster

[11] Patent Number: 4,646,917

[45] Date of Patent: Mar. 3, 1987

[54] REINFORCED ARTICLE CARRIER

[75] Inventor: Richard L. Schuster, West Monroe, La.

[73] Assignee: Manville Sales Corporation, Denver, Colo.

[21] Appl. No.: 783,298

[22] Filed: Oct. 2, 1985

[51] Int. Cl.[4] ..... B65D 65/12; B65D 65/14; B65D 85/72; B65D 71/00

[52] U.S. Cl. ..... 206/434; 206/147; 206/152; 206/140; 383/119

[58] Field of Search ..... 206/434, 147, 148, 152, 206/161, 140; 383/119

[56] References Cited

U.S. PATENT DOCUMENTS

| | | | |
|---|---|---|---|
| 205,840 | 7/1878 | Davenport | 383/119 |
| 1,333,717 | 3/1920 | Jackson, Jr. | 383/119 |
| 2,610,936 | 9/1952 | Carlson | 383/119 |
| 3,395,791 | 8/1968 | Graser | 206/434 |
| 3,478,951 | 11/1969 | Graser | 206/140 |
| 3,746,607 | 7/1973 | Harmon et al. | 383/119 |
| 4,029,204 | 6/1977 | Manizza | 206/434 |
| 4,301,961 | 11/1981 | Rodish | 383/119 |
| 4,453,630 | 6/1984 | Helms et al. | 206/147 |

FOREIGN PATENT DOCUMENTS

| | | | |
|---|---|---|---|
| 356489 | 9/1931 | United Kingdom | 383/119 |

*Primary Examiner*—William Price
*Assistant Examiner*—Brenda J. Ehrhardt
*Attorney, Agent, or Firm*—John D. Lister; Cornelius P. Quinn; Gregory A. Evearitt

[57] ABSTRACT

A wrap-around carrier formed of relatively thin paperboard reinforced with strands extending along the length of the carrier blank. In addition, the interlocking and overlapping bottom wall portions of the carrier are adhesively connected for further reinforcing. This design permits use of thinner paperboard without sacrificing the load carrying ability of the carrier.

14 Claims, 4 Drawing Figures

40
40a
25
30
38a
38
21
22
23
23
13
15
24
50
27
14
26
18
15
50
50
16
13
12
21
34
34a
32a
28
25
32
36

REINFORCED ARTICLE CARRIER

FIELD OF THE INVENTION

This invention relates to wrap-around article carriers of the type commonly used to hold soft drink or beer containers. More particularly, it relates to carriers of this type which are more economical to produce yet function the same.

BACKGROUND OF THE PRIOR ART

Wrap-around article carriers have been in use for many years and have been developed to the point where they are a highly efficient and economical carrier, capable of being formed from blanks at the high speeds required by modern packaging or bottling facilities. In general, their construction is such that their sides completely enclose the articles contained in the package except for cutouts located to hold the heels or bases of the articles in place and, where appropriate, to retain the necks of the articles. The ends of the carrier are open. Finger holes in the top wall of the carrier permit easy handling by the purchaser. This construction basically supports the bottoms of the articles and is designed so that the end portions of the carrier blanks, which join together to form the bottom wall of the carrier, mechanically interlock to provide a secure construction.

A competitive carrier is the plastic type that holds the articles in place through support means engaging the upper portions of the articles. With this type of carrier the articles are suspended from the carrier rather than supported by it, as in the wrap-around design.

The wrap-around design has several advantages over the cheaper plastic type. The articles are better protected against breakage due to the fuller coverage afforded by the wrap-around design. This is important to the bottlers, to store owners and to the customers. The carriers permit convenient stacking and are easy to handle and carry. Further, advertising can be printed on the sides of the carriers, which is important to the producer of the articles being carried.

In order to continue providing the added advantages of wrap-around carriers it is important that the industry find ways to reduce costs without adversely affecting the basic design. This is considerably more difficult than it might first seem. The general design used throughout the industry is the result of countless improvements made over the years. This honing of the design has resulted in a carrier the features of which the industry would be reluctant to change. Certainly changes which would adversely affect the speed and efficiency of the packaging machines now in use would not be welcome.

The dilemma, therefore, is to reduce costs without changing the basic functional design.

SUMMARY OF THE INVENTION

This invention solves the cost cutting problem not by redesigning the basic carrier itself but by using a thinner and therefore more economical base material. Because the material currently used for wrap-around carriers had already been engineered down to a relatively thin caliper, this produced potentially grave problems. A thinner material would tend to tear or collapse at the finger holes and at the bottom cutouts when the filled carrier is lifted. Further, a thinner material would tend to be too flimsy for the mechanical locking system at the bottom of the carrier to hold together. The tendency, particularly when the carriers are stored or used in areas of high humidity, is for the locking tabs to disengage.

The present invention solves all the above problems by making use of relatively minor reinforcing along the length of the blank and at the locking tab area to strengthen the carrier to the point where it can function properly even though a thinner caliper material is used. In a preferred embodiment, reinforcing strands are adhered to the carrier blank at strategic locations and the overlapping end portions of the blank in the area of the locking tabs are further adhered together.

DESCRIPTION OF THE INVENTION

Figure 1:
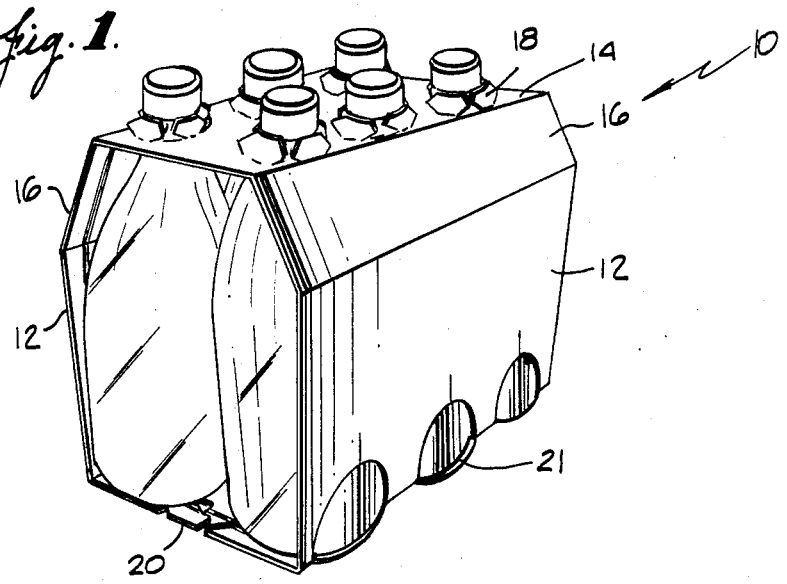
FIG. 1 is a perspective view of a typical filled wrap-around carrier depicting the general design of carrier in popular use today.

Referring to FIG. 1, a typical wrap-around carrier 10 of the general type to which this invention relates is comprised of side walls 12 connected to a top wall 14 by sloped portions 16. The sloped portions are integral with the top and side walls and are foldably connected thereto. This allows for articles of a generally uniform shape to be carried but permits the shape or the placement within the carrier to vary to a small degree. In the illustrated carrier 10, soft drink bottles are shown as fitting securely in the space provided between the side walls 12 and sloped portions 16. Neck retainers 18 consisting of folded flaps concentrically arranged around openings in the top wall 14 serve to hold the necks of the bottles in place. Finger holes, not shown, would be located in the top wall 14 to permit the carrier to be readily lifted. The bottom wall 20 is formed by the joined or locked end portions of the carrier blank, and heel cutouts 21 are provided to receive the outer base or bottom portion of the bottles to help hold them in place. This overall design is typical of both the prior art carriers and the carrier of the present invention.

Figure 2:
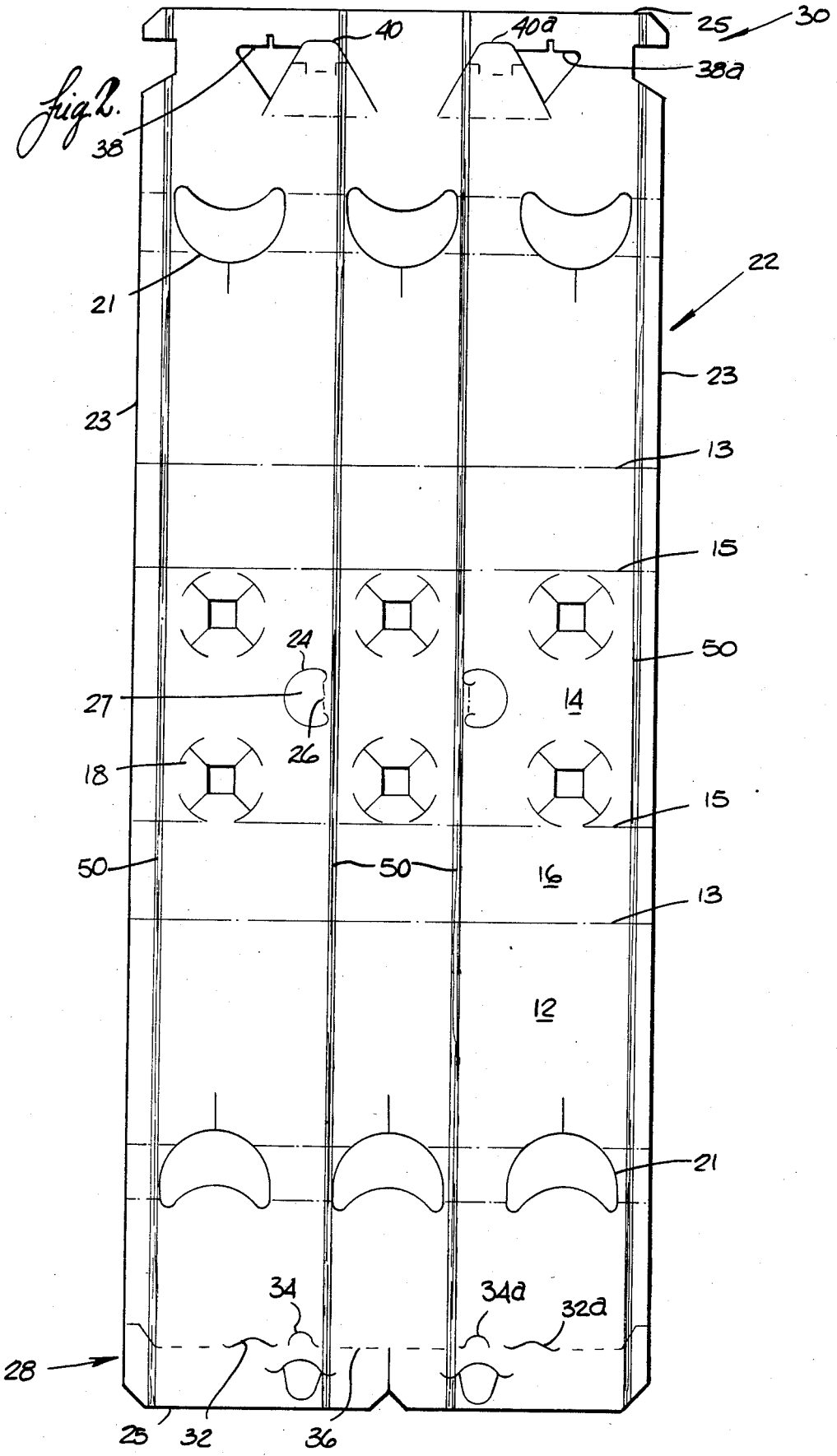
FIG. 2 is a plan view of the inside face of a blank used to form a carrier of the type shown in FIG. 1, but containing reinforcing in accordance with the present invention.

Referring to FIG. 2, a blank 22 of generally rectangular shape, comprised of generally parallel long edges 23 and generally parallel short edges 25, is used to form the carrier 10 shown in FIG. 1. The intermediate portions of the blank corresponding to side walls 12, the central portion of the blank corresponding to top wall 14, and the sloped portions 16 are correspondingly numbered in this view and can be seen to be connected to each other by fold lines 13 and 15. It should be understood that although the sloped wall portion 16 is described herein it is not essential to the invention that it be present. For purposes of the invention the sloped portion can just as readily be considered as part of the top wall or side wall or it can even be considered as comprising part of the foldable connection between the top and side walls.

Neck retainers 18 are shown in top wall 14 for use when the articles being packaged are bottles. Tabs 27 are cut out along the solid border 24 and are adapted to be punched out and folded along the inner facing fold lines 26 by the purchaser to form finger holes. The heel cutouts 21 are also shown on the blank.

End portions 28 and 30 of the blank 22 are adapted to overlap each other in the formation of the carrier and to be mechanically held together by an interlocking tab arrangement. A typical arrangement is shown in FIG. 2 as consisting of tabs 32 and 34 on the left side of the blank, and a similar pair of tabs 32*a* and 34*a* on the other side. These are arranged on a score or fold line 36 and are adapted to fit under cutouts 38 or 40 and 38*a* or 40*a*. Although any type of locking means that adequately holds the end portions 28 and 30 together could be used, the type shown is adapted to selectively use, on the left side, tab 32 and cutout 38 or tab 34 and cutout 40, while on the right side either tab 32*a* and cutout 38*a* would be engaged or tab 34*a* and cutout 40*a* would be engaged. This permits selectively operable locks to accommodate different package perimeters, and is described more fully in U.S. Pat. Nos. 3,395,791 and 3,478,951, both of which are incorporated herein by reference.

Figure 3:
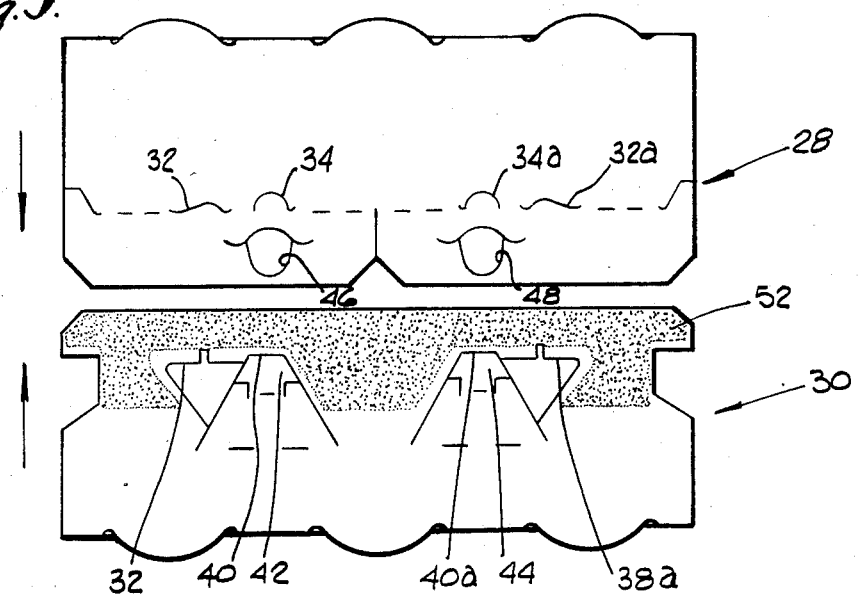
FIG. 3 is a plan view of the outer faces of the two end portions of the blank of FIG. 2 as they would appear just prior to being mechanically interlocked.
Figure 4:
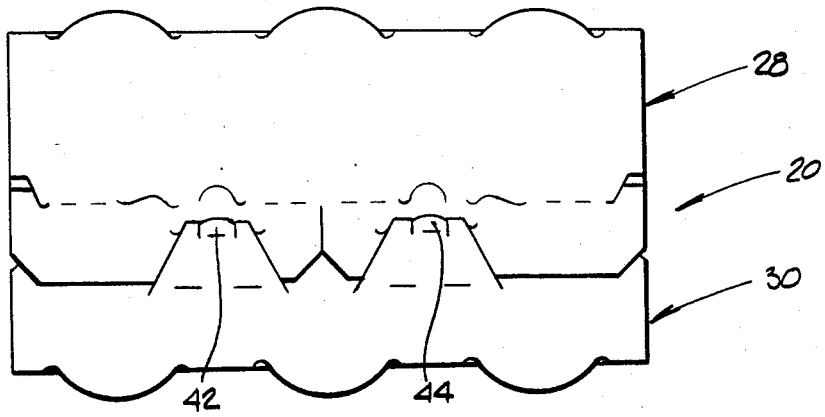
FIG. 4 is a plan view of the outer faces of the same two end portions shown in FIG. 3, but now in their locked position.

The action of the locking tabs is shown further in FIGS. 3 and 4. FIG. 3 shows the end portions 28 and 30 in alignment just prior to being moved into interlocking relationship and FIG. 4 shows the bottom wall 20 formed from the two end portions, with end portion 28 overlying end portion 30. Although the details of the locking mechanism do not form a part of this invention, for purpose of clarity it will be understood that one or more of the operable tabs 32, 34, 32*a* and 34*a* engage the underside of cutouts 38, 40, 38*a* and 40*a*, and that further, the scored ends of tabs 42 and 44 fit into openings 46 to 48 to complete the locking mechanism.

Typically, wrap-around carriers of the prior art have been formed from blanks comprised of paperboard having a caliper in the approximate range of 23–25 points, where one point equals 0.001 inch. To reduce the thickness enough to produce a significant economic benefit, it has been found that two modifications are necessary. Reinforcing strands 50, shown in FIG. 2, are provided, and the end portions 28 and 30 are further adhered together as shown in FIG. 3 by adhesive layer 52. It has been found that this combination of strengthening surpisingly allows paperboard having a caliper of only 18–20 points to be used.

The strands 50 can be of any material capable of adding reinforcing strength when adhered to the blank, such as cotton, fiber glass or other synthetic fibers. In practice, it was found that a cotton/polyester blend sold by H. B. Fuller Co. under the mark "String King" 1093 worked very well. This material, which is supplied with heat activated adhesive preapplied to the strands, can be applied directly to the blank stock by suitable guide and pressure rolls well known in the art and will adhere to the stock upon exposure to temperatures sufficient to activate the adhesive. In the case of the H. B. Fuller material, the temperature was about 325° F. Preferably the strands should be located closely adjacent to the outer heel cutouts, between the cutouts and the outer edge of the blank.

The adhesive material 52 which supplements the mechanical locking tabs to hold the end portions 28 and 30 together to form the bottom wall 14 of the carrier can be any suitable adhesive which has sufficient bonding strength. The amount of adhesive and its bonding strength will vary depending on the caliper of the paperboard and the efficiency of the locking tabs. In practice it has been found that a cold pressure activated adhesive works well since this would prevent inadvertent adherence of the adhesive to other surfaces before the blank is formed into the carrier. As an example, 528G adhesive sold by S&R Adhesive Corporation was applied to the outer surface of the end portions of the carrier blanks and, upon being overlapped by the other end portions during formation of the carriers, the end portions adhered together due to the ordinary pressures encountered in the carrier forming process. A heat activated adhesive of the type which can be printed directly onto the blank stock and then activated by hot air, for example, would also work well. Obviously, the adhesive could just as well be applied to the underside of the overlapping end portion instead of to the outer side of the end portion to be overlapped, or it could be applied to both surfaces if desired. The amount and type of adhesive used, in any event, must be sufficient to prevent failure of the mechanical locking system through ordinary use of a carrier formed from thinner stock than is conventionally used in wrap-around carriers.

As a further improvement, reinforcing strands 50, as shown in FIG. 2, can also be applied closely adjacent the inner extremities or fold lines 26 of the carrier finger holes to prevent crushing of the stock at these stress points. Preferably, the strands should be located as close as possible to the fold lines forming the inner extremities of the finger holes. Normally, these strands would not be needed if the caliper of the stock is at least 20 points. It has been found desirable, however, when paperboard having a lesser caliper is used, such as in the range of 16–17 points.

Obviously, different embodiments of the invention, such as specific arrangements differing in some respects from the foregoing description, may be used without departing from the spirit and scope of the present invention.

What is claimed is:

1. An open-ended wrap-around article carrier comprising:

a top wall;

side walls integral with and foldably connected to the top wall;

bottom wall portions integral with and foldably connected to the side walls, the bottom wall portions having means for structurally interlocking with each other in overlapping relationship to form a bottom wall;

the side walls having cutouts therein adjacent the foldable connections to the bottom wall portions to receive base portions of the articles being carried, reinforcing strands adhered to the side walls and bottom wall portions adjacent the foldable connections therebetween;

the reinforcing strands being generally parallel to the edges forming the open ends of the carrier and being located between said edges and the cutout portions; and means adhesively securing the interlocking and overlapping bottom wall portions to each other.

2. A wrap-around article carrier according to claim 1, wherein the article carrier is designed to carry beverage bottles and the walls are comprised of paperboard having a caliper of at least 18 points but less than 23 points.

3. A wrap-around article carrier according to claim 1, wherein the reinforcing strands are continuous strands adhesively connected to the inner surface of the carrier adjacent the edges froming the open ends of the carrier.

4. A wrap-around article carrier according to claim 1, wherein the reinforcing strands comprise a cotton/-polyester blend.

5. A wrap-around article carrier according to claim 1, wherein the top wall has finger holes therein and wherein additional reinforcing strands are located adjacent to and between the finger holes.

6. A wrap-around article carrier according to claim 5, wherein at least four reinforcing strands are continuous strands adhesively connected to the inner surface of the carrier, two of which are located generally parallel to the edges forming the open ends of the carrier between said edges and the cutout portions, and the other two of which are parallel to the first two strands and are located adjacent to and between the finger holes.

7. A wrap-around article carrier according to claim 6, wherein the walls of the carrier are comprised of paperboard having a caliper of at least about 16 points but less than about 20 points.

8. A blank adapted to be folded to form a wrap-around article carrier, comprising:

two generally parallel long edges connected by two generally parallel short edges to form an elongated generally rectangular shape;

a central portion of the rectangle intended to become the top wall of the carrier, end portions of the rectangle intended to interlock and form the bottom wall of the carrier when the blank is folded into carrier shape, and intermediate portions between the central portion and the end portions intended to become the side walls of the carrier;

an adhesive coating on at least one of the end portions adapted to adhesively contact the other end portion when the blank is folded into carrier shape;

the blank having cutouts adjacent the juncture between the intermediate portions and the end portions, the cutouts being adapted to receive base portions of the articles to be carried after the blank is folded into carrier shape; and reinforcing strands located between the cutouts and the long edges and being generally parallel to the long edges.

9. A blank according to claim 8, wherein the wrap-around carrier formed from the blank is designed to carry beverage bottles and wherein the blank is comprised of paperboard having a caliper of at least about 18 points but less than about 23 points.

10. A blank according to claim 8, wherein the reinforcing strands are continuous strands adhesively connected to the surface of the blank intended to become the inner surface of the carrier.

11. A blank according to claim 10, wherein the reinforcing strands comprise a cotton/polyester blend.

12. A blank according to claim 10, wherein the central portion contains means adapted to become finger holes in the top wall of the carrier and wherein additional reinforcing strands are located adjacent to and betweeen the finger hole means.

13. A blank according to claim 12, wherein the additional reinforcing strands comprise continuous strands adhesively connected to the surface of the blank intended to become the inner surface of the carrier and being parallel to the first continuous reinforcing strands.

14. A blank according to claim 12, wherein the blank is comprised of paperboard having a caliper of at least about 16 points but less than about 20 points.

* * * * *